US009377181B1

(12) United States Patent
Lauer

(10) Patent No.: US 9,377,181 B1
(45) **Date of Patent: *Jun. 28, 2016**

(54) ILLUMINATION DEVICE AND METHOD FOR ILLUMINATION WITH PLURALITY OF SIMULATED CANDLE FLAMES

(71) Applicant: Mark A. Lauer, Pleasanton, CA (US)

(72) Inventor: Mark A. Lauer, Pleasanton, CA (US)

( * ) Notice: Subject to any disclaimer, the term of this patent is extended or adjusted under 35 U.S.C. 154(b) by 30 days.

This patent is subject to a terminal disclaimer.

(21) Appl. No.: 14/100,231

(22) Filed: Dec. 9, 2013

Related U.S. Application Data

(63) Continuation of application No. 13/314,495, filed on Dec. 8, 2011, now Pat. No. 8,602,610, which is a continuation-in-part of application No. 12/966,860, filed on Dec. 13, 2010, now Pat. No. 8,235,558, which is a continuation of application No. 11/895,246, filed on Aug. 22, 2007, now Pat. No. 7,850,346.

(60) Provisional application No. 60/840,210, filed on Aug. 24, 2006.

(51) Int. Cl.
*F21V 14/08* (2006.01)
*F21V 9/16* (2006.01)

(52) U.S. Cl.
CPC .. *F21V 14/08* (2013.01); *F21V 9/16* (2013.01)

(58) Field of Classification Search
CPC ..... F21V 9/16; F21V 35/00; F21V 14/08; B04C 5/06; F21S 6/001; F21S 10/04; F21O 1/02; F21W 2121/00
USPC ..... 362/96, 101, 161, 392, 393, 398, 386, 362/272
See application file for complete search history.

(56) References Cited

U.S. PATENT DOCUMENTS 5,119,281 A * 6/1992 Akman ..... 362/253
7,036,958 B2 * 5/2006 Hayne et al. ..... 362/352
8,602,610 B1 * 12/2013 Lauer ..... 362/392

FOREIGN PATENT DOCUMENTS

GB 2242736 A * 10/1991 ..... F24C 7/004

* cited by examiner

*Primary Examiner* — Robert May
*Assistant Examiner* — John A Ward
(74) *Attorney, Agent, or Firm* — Mark Lauer; Silicon Edge Law Group LLP

(57) ABSTRACT

An artificial candle has a delicate glowing shroud or sock that can flutter like a candle flame, and the shroud may surround a "wick" that can be seen through the shroud to glow. Such a diaphanous shroud can be actuated by a fan, air pump, solenoid or conductor, which can be provided adjacent to the shroud or distanced from the shroud, for example in a central body of a chandelier. The wick may be lighted by a light emitting diode (LED), and the shroud can include fluorescent material that absorbs and reradiates some of the light from the wick. The wick and the shroud can be coupled to a shaft that simulates a wax candle body. A standard threaded fitting can be provided so that the artificial candle can thread into a socket to replace a light bulb.

21 Claims, 7 Drawing Sheets

ILLUMINATION DEVICE AND METHOD FOR ILLUMINATION WITH PLURALITY OF SIMULATED CANDLE FLAMES

CROSS-REFERENCE TO RELATED APPLICATIONS

This application is a continuation of application Ser. No. 13/314,495, filed Dec. 8, 2011, which is a continuation-in-part of application Ser. No. 12/966,860, filed Dec. 13, 2010, which is a continuation of application Ser. No. 11/895,246, filed Aug. 22, 2007, which claims the benefit under 35 USC 119 of Provisional Application No. 60/840,210, filed Aug. 24, 2006. All of the above-listed applications are incorporated by reference herein.

BACKGROUND

The present application relates to lighting and illumination devices and systems.

Although beautiful, candles have been virtually replaced by the invention of electrically powered light bulbs, which have many advantages but typically are not as aesthetically pleasing. There has been a longstanding need to create an electrically powered light bulb that has the beauty of a candle. For example, beautiful chandeliers with intricate metal frames and multiple, dangling crystalline jewels are typically adorned with light bulbs that at best look artificial. To fix this problem, light bulbs have been fashioned with a pointed end or spiral shape, have been illuminated with light that changes in voltage or current or is shuttered to vary in intensity, all in an attempt to look like a candle flame. Despite myriad patent applications, issued patents and multiple products that attempt to simulate candle flames, a need still exists to have an electrically powered light that is more beautiful, and a need still exists to have such a light that simulates the appearance of a candle or other flame.

SUMMARY

In one embodiment, an illumination device is disclosed comprising: a light source that emits electromagnetic radiation; a flexible sock that is operably coupled to the light source to receive the radiation and consequently transmit visible light from the sock; and an actuator that is operably coupled to the sock to change the shape of the sock.

In one embodiment, a method for illumination is disclosed comprising: providing a flexible sock that is operably coupled to a light source; emitting electromagnetic radiation from the light source such that the radiation impinges upon the sock; transmitting, by the sock, visible light in response to receiving the radiation from the light source; and moving the sock so that the sock changes shape while transmitting the light.

In one embodiment, an illumination device is disclosed comprising: a light source that simulates a glowing candle wick; a flexible shroud that substantially surrounds the light source to simulate a candle flame; and an actuator that is operably coupled to the shroud to change the shape of the shroud to simulate flickering of the candle flame.

In one embodiment, an illumination device is disclosed comprising: a chandelier including a plurality of simulated candles, each of the candles including: a light source that simulates a glowing candle wick; a flexible sock that substantially surrounds the light source to simulate a candle flame; and means for changing the shape of the sock to simulate flickering of the candle flame.

In one embodiment, an illumination device is disclosed comprising: a pole that simulates a glowing candle wick; a flexible shroud that substantially surrounds the pole to simulate a candle flame; an actuator that is operationally coupled to the shroud to change the shape of the shroud to simulate flickering of the candle flame; and conductive threading to fit into a light socket and provide electrical power.

In one embodiment, an illumination device such as mentioned above may include a light emitting diode (LED). Air flow that cools the LED may cause the shroud to move while the LED illuminates the shroud, simulating a candle flame.

This summary does not purport to define the invention, embodiments of which are described throughout this application, and which is defined by the appended claims.

DETAILED DESCRIPTION

Figure 1:
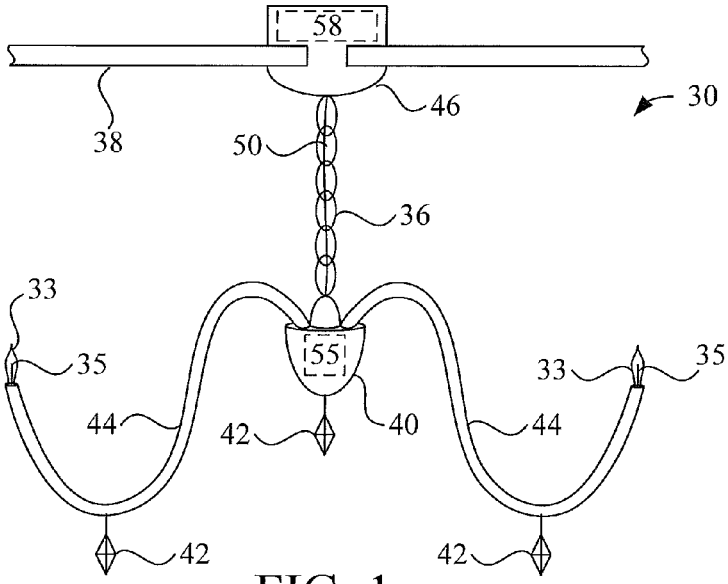
FIG. 1 is a side and schematic view of an embodiment of an illumination device such as a chandelier.

FIG. 1 shows an embodiment of an illumination device 30 such as a chandelier. The chandelier 30 has a plurality of delicate, glowing socks 33 that transmit visible light while moving so as to simulate candle flames. Operably coupled to each sock 33 is a light source 35, which emits electromagnetic radiation such as visible, infrared or ultraviolet light. In one embodiment the light source 35 is a light-emitting diode (LED), and the sock 33 is a flexible and translucent shroud that may transmit, diffuse, reflect and/or refract the radiation from the LED. The light source 35 may be disposed at the tip of a small pole that simulates a candle wick, or the light source can include a larger section of such a pole, such as one-half the length of the pole, which glows like a candle wick through the diaphanous sock. The sock 33 may also include fluorescent material that absorbs at least some of the radiation from the light source 35 and thereupon emits visible light.

The chandelier 30 hangs by a chain 36 from a wall 38 such as a ceiling of a room. The chandelier 30 has a centrally located body 40 to which a pair of arms or tubes 44 are attached, each tube holding a light source 35 and flexible sock 33. The chandelier 30 also has a plurality of crystals 42, which hang from the tubes 44 and body 40. The chandelier 30 has a mounting apparatus 46 that attaches the chandelier to the ceiling 38, and a conduit or plurality of conduits 50 that runs between the mounting apparatus 46 and the body 40 to carry electricity and/or gas such as air.

The illumination device 30 contains an actuator that is operably coupled to the sock 33 to move the sock relative to the light source 35, so that the sock changes shape or position. As one example, the actuator can include an air pump 55 or fan that is disposed within the body 40 and which is in fluid communication with each sock 33 via its respective tube 44. When the air pump or fan 55 forces air through tube 44, the sock 33 can be made to inflate or otherwise move. Alternatively, another tube, such as a plastic hose, can be disposed within each tube 44 to provide air to the sock 33 from the fan 55. In either case an electrical lead can be disposed within each tube 44 to provide electrical power to light source 35.

Alternatively, an air pump 58 or fan can be disposed within the mounting apparatus 46 and in fluid communication with each sock 33 via its respective tube 44. In this embodiment, the conduit or conduits 50 carry air and electricity that powers the light source. The electricity may in this case be converted from alternating current (AC) to direct current (DC) of a voltage and current appropriate for light source 35 by a converter 55. Having an air pump or fan that is disposed on the other side of a wall from the room in which the illumination device is located can allow for a larger, more powerful and noisier air pump or fan 55 that is nevertheless quieter and less extensive within the room. Alternatively, an air pump, fan and/or AC/DC converter can be disposed within mounting apparatus 46 or another portion of the chandelier within the room housing the light source 35 and sock 33.

Conversely, an AC/DC converter 58 can be disposed within the mounting apparatus 46 and in electrical communication with a fan or air pump 55 disposed within the body of the chandelier 30. In this embodiment, the conduit or conduits 50 carry DC electricity that powers the light sources 35. The tubes 44, or conduits within the tubes, may in this embodiment carry air as well as DC electricity for powering the light sources 35. As will be seen, electricity need not be converted from AC to DC, although a voltage divider may be employed to reduce voltage, e.g., from household voltage levels to that required for an LED, while a motor for an air pump or fan can be connected in parallel and use higher voltage and/or current levels. Also, as shown in other figures, a candle shaft may be employed that is coupled to the light source 35 and sock 33. The candle shaft in this case may contain an actuator such as a fan or solenoid, as well as any auxiliary electronics, such as a voltage divider and/or converter.

The shape of the sock is suited to trapping air and so is more receptive to movement induced by a small amount of air than a sheet or flap of similar material would be. The sock need not be closed or without holes in order to react more dramatically than a flap of similar material to a relatively small wind or difference in air pressure. In addition, the sock shape that resembles a pointed egg provides a more realistic simulation of a candle flame that surrounds a burning wick than does a flap, even though such a flap may have a jagged profile in an attempt to simulate a flame. Like a candle flame, the sock when inflated may have a somewhat oblong or oval shape, with a wick-like pole extending partly along its axis.

Alternatively, as discussed in more detail below, a centrally located air pump or fan need not be provided for moving the delicate glowing socks. Instead, the glowing socks 33 can be made to inflate, move and/or flicker due to electrical or magnetic forces, or air pumps or fans, that are disposed adjacent to the glowing socks 33. In any case, the beautiful socks can glow with a yellow light that is soft like candle light, as opposed to the sometimes harsh light from an incandescent, fluorescent or other conventional light bulb.

A surprising advantage of the actuation of the vaporous glowing socks 33 can be the slight reciprocal motion induced in the chandelier, which can cause slight movement of the crystals 42. A very slight movement of the crystals can be intriguing and beautiful. For example, beginning or ending rotation of either centrally or distally disposed fans can cause the chandelier to rotate slightly in an opposite direction, and a slight rotation of the crystals can result in a relatively large sweep of the location from which the light observed in the crystals is refracted. Moreover, the sound of the socks inflating and fluttering may sound like candles being lit and flickering. The chandelier 30 shown in FIG. 1 is drawn simplistically to facilitate understanding of the invention, but of course may have many more light sources 35 and socks 33, arms or tubes 44, crystals 42 and body 40 sections.

Figure 2:
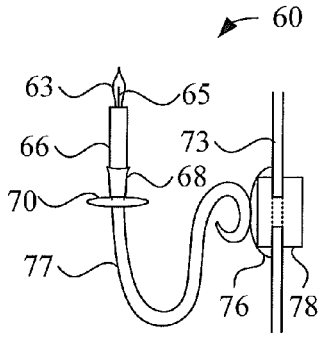
FIG. 2 is a side and schematic view of an embodiment of an illumination device such as a wall sconce.

FIG. 2 shows an embodiment of an illumination device 60 such as a wall sconce. The wall sconce 60 has a delicate sock 63 that transmits visible light while moving so as to simulate a candle flame. Operably coupled to the glowing sock 63 is a light source 65, which emits electromagnetic radiation such as visible, infrared or ultraviolet light. In one embodiment the light source 65 is a LED, and the sock 63 is flexible and translucent, and may transmit, diffuse, reflect and/or refract the radiation from the LED. The glowing sock 63 may also include fluorescent material that absorbs at least some of the radiation from the light source 65 and thereupon emits visible light.

The illumination device 60 includes a generally cylindrical shaft 66 that is designed to look like a paraffin wax body of a candle. The shaft 66 is held by what appears to be a candle holder 68, with a flange 70 provided to appear to catch candle wax that drips from the shaft 66. A tubular arm 77 is coupled to the candle holder 66 and flange 70, the arm held to a wall 73 by an attachment apparatus 76. A conduit or plurality of conduits, not shown, runs between the attachment apparatus 76 and the candle shaft 68 to carry electricity and/or gas such as air. An air pump and/or electronics such as an AC/DC converter or voltage divider may be disposed on either side of the wall 73.

The illumination device 60 contains an actuator that is operably coupled to the sock 63 to move the light sock relative to the light source 65, so that the sock changes shape or position. As one example, the actuator can include an air pump 78 or fan that is disposed adjacent to the attachment apparatus 76 on either side of the wall 73 and in fluid communication with the sock 63 via tubular arm 77. When the air pump or fan 78 forces air through arm 77, the sock 63 can be made to inflate or otherwise change shape. The sock may deflate on its own due to the force of gravity when the air pump is not inflating the sock, or a fan may reverse the air flow and/or pressure to deflate the sock. Alternatively, another tube, such as a plastic hose, can be disposed within tube 77 to provide air to the sock 63 from the fan 78. In either case an electrical lead can be disposed within tube 77 to provide electrical power to light source 65.

Conversely, an AC/DC converter 58 can be disposed within the mounting apparatus 46 and in electrical communication with a fan or air pump 55 disposed within the body of the chandelier 30. In this embodiment, the conduit or conduits 50 carry DC electricity that power the light sources 35. The tubes 44, or conduits within the tubes, may in this embodiment carry air as well as DC electricity for powering the light sources 35.

Although a chandelier and wall sconce have been explicitly illustrated in the previous figures, other embodiments of illumination devices can alternatively be employed, such as candelabras, Christmas tree lights, lamps, etc.

Figure 3:
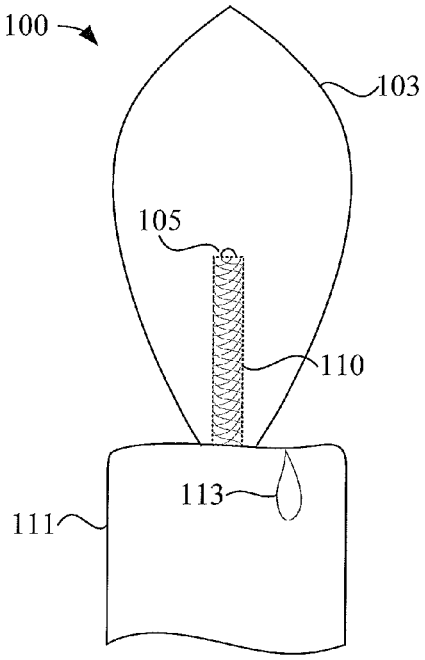
FIG. 3 is a side view of an embodiment of an illumination device that includes a flexible glowing sock that substantially surrounds a light source such as a LED.

FIG. 3 is a side view of an embodiment of an illumination device 100 that includes a flexible glowing sock 103 that substantially surrounds a light source such as a LED 105. The LED 105 is disposed atop a pole 110 that is designed to look like a candle wick, with the wick attached to a shaft 111 that has the waxy, slightly translucent appearance of a candle body. For example, the pole 110 in this example is wrapped with a woven material such as cloth to simulate a candle wick, and the shaft 111 can be made of a cloudy but translucent plastic that has a polished finish or is coated with wax. The pole 110 can be crooked rather than straight, again to simulate a candle wick, and the shaft 111 can also be imperfect, and may include protrusions 113 that simulate dripping wax. The LED is partly visible through the glowing sock 103 in this embodiment, to have the appearance of a glowing tip of a candle wick. The pole 110 can be black, to simulate a burned candle wick, except at the tip where it glows from the LED. In an alternative embodiment, more of the "wick" can be made to glow, e.g., by locating a LED near the middle of the pole with the portion of the pole disposed above the LED made of translucent material that redirects the light from the LED. Similarly, the LED 105 can be recessed slightly compared to that shown in FIG. 3, so that from the side the light from the LED all passes through a wall of the pole 110, whereas upper portions of the sock may be illuminated with radiation from the LED that does not pass through the pole. Alternatively, LED 105 can have a flange that is attached to the end of pole 110, with holes that may act as nozzles in the flange and/or the pole providing air that moves the sock 103 from the pole.

Figure 4:
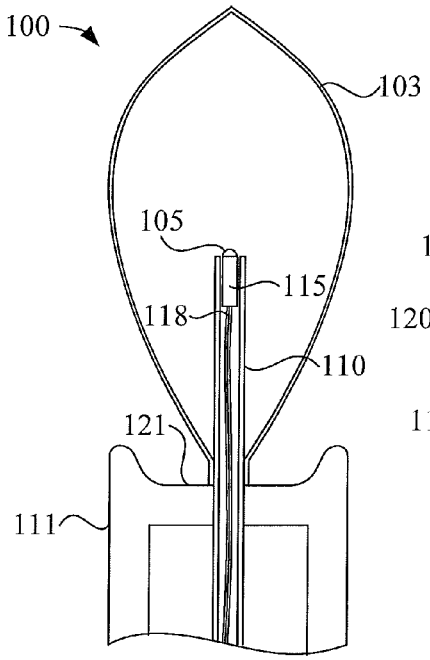
FIG. 4 shows a cross-sectional view of the illumination device of FIG. 3.

FIG. 4 shows a cross-sectional view of the illumination device 100 of FIG. 3. The sock 103 may include woven material that is natural or synthetic, such as silk or cotton, nylon or rayon, or may be made of a solid or perforated sheet, for example a thin layer or film of plastic. Woven material can diffuse the light from the sock and soften the edges of the sock to look more like a flame that does not have a distinct border. The sock 103 may include colored or fluorescent material, and such material may be painted (e.g., sprayed) onto the woven, perforated or solid sheet, on an interior and/or exterior surface of the sock. Fluorescent paint is commercially available from many sources; for example, see www.krylon.com.

The sock 103 is shown in an inflated state in which it is separated from the pole or wick 110 except near a bottom portion of the pole, where the sock may be attached to the pole or the shaft 111. To simulate a candle flame, the sock may be teardrop shaped and have a height of about ten centimeters or less.

The pole 110 in this embodiment is a hollow tube that extends through a hole in the shaft 111, the tube containing electrical leads 118 for the LED 105, which has a body 115 that is held near a top end of the pole. The pole 110 also forms a conduit for air or other gas that provides inflation and other movement of the sock 103. The shaft 111 has a recessed portion 121 that appears as though wax adjacent to the "wick" 110 has melted away, and also provides a receptacle that holds the sock 103 when it is deflated. The pole 110 may be attached to the shaft 111 with an adhesive such as epoxy, may be clamped to the shaft, or may simply be fitted snuggly into a mating aperture in the shaft.

The air flow and/or pressure provided to sock 103 can be made to fluctuate, causing the shape of the sock to change and the sock to flutter like a candle flame. In addition, the sock 103 may simply change shape due to ambient wind or other forces, again giving the appearance of a flickering candle flame. As an example, a room fan that is part of a chandelier may cause candle-like socks of the chandelier to flicker due to the wind generated by the room fan. Alternatively, such a room fan can be used to inflate the socks. The current and/or voltage provided to LED 105 can also change, causing the intensity of light from the LED and the sock 103 to change, which may correspond to changes in the shape of the sock.

In an exemplary embodiment, the sock 103 can be stained with a fluorescent yellow material that absorbs and reradiates yellow and higher frequencies of light, and LED 105 can emit white light that makes the sock glow yellow while the LED 105 appears to an outside observer to be red or orange, because those lower frequency colors are not absorbed by the sock. Similarly, with sock 103 including a fluorescent yellow material that absorbs and reradiates yellow and higher frequencies of light, LED 105 can emit a spectrum of light having a peak intensity of yellow, which makes the sock glow yellow while the LED 105 appears to be orange, a color which is not absorbed by the sock.

Figure 5:
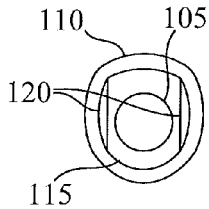
FIG. 5 is an expanded top view of the light source of FIG. 3 and FIG. 4.

FIG. 5 is an expanded top view of the light source of FIG. 3 and FIG. 4. The body 115 for the LED 105 can for example be fitted snugly into tube 110 so as to slightly distort the shape of the tube. The LED 105 can be one of any number of commercially available discrete LEDs, such as a 3 mm, 4 mm or 5 mm discrete LED from www.dialight.com, www.ledtronics.com or www.extremeled.com. A pair of apertures 120 allow the air to flow from the tip of the tube, the apertures substantially smaller in cross-sectional area than the interior portion of the tube 110 that is not plugged with the LED body 115, so that air is forced out of the apertures at relatively high speed and pressure compared to the remainder of the tube. A commercially available LED body can be modified to provide the size and number of apertures 120 as desired, and to create apertures 120 that act as nozzles that increase the speed and pressure of the air flow that actuates the sock 103. The air flow ejected from nozzles or apertures 120 can be turbulent, which can cause the glowing sock 103 to flutter, giving it the appearance of a flickering candle flame. The air that flows through apertures 120 can cool the LED 105, which may prolong its life and keep the sock from overheating during contact with the LED. The air flow can also continue temporarily after the LED is turned off to cool the LED before the sock deflates, for example by using a delay circuit. In contrast to conventional incandescent or fluorescent light bulbs that employ a low pressure or vacuum, the sock may have an elevated pressure during operation.

Figure 6:
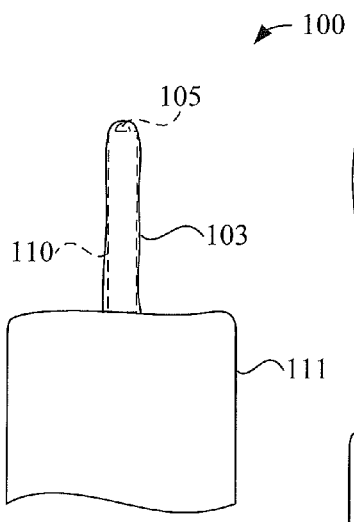
FIG. 6 is a side view of the illumination device of FIG. 3 and FIG. 4, in which the sock is deflated and the LED is turned off.

FIG. 6 is a side view of the illumination device 100 of FIG. 3 and FIG. 4, in which the flimsy sock 103 is deflated and the LED 105 is turned off. Most of the sock has fallen out of view, into the recessed portion 121 shown in FIG. 4. In this state, the illumination device 100 looks like a candle that is not burning, with the "wick" 110 draped with the flimsy sock 103. In contrast, glass or plastic light bulbs of the prior art that attempt to simulate candle flames when turned on look even more artificial when turned off and the bulbs remain as unlit monuments. Because the pole 110 in this state does not provide light and the sock 103 surrounds the pole, the sock does not glow like it does when irradiated by the LED 105. In one embodiment, the sock may have a hole in its upper region, and when deflated the sock falls so that the "wick" penetrates the hole and essentially all of the sock falls into a recessed portion and out of sight, leaving the "wick" exposed and unlit, just as with a candle.

Figure 7:
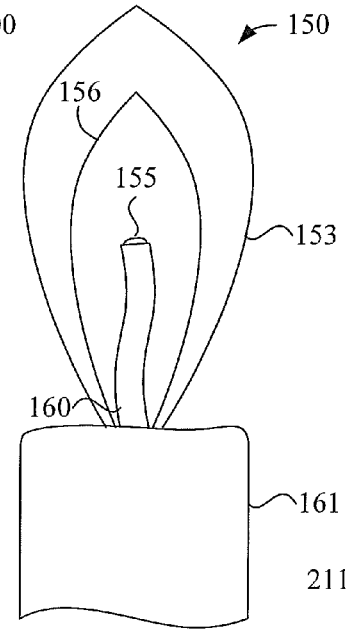
FIG. 7 is a side view of an embodiment of an illumination device that includes a first glowing sock 153 and a second glowing sock that substantially surround a light source such as a LED.

FIG. 7 is a side view of an embodiment of an illumination device 150 that includes a first glowing sock 153 and a second glowing sock 156 that substantially surround a light source such as a LED 155. As before, the LED 155 is disposed atop a crooked pole 160 that is designed to look like a candle wick, with the wick attached to a shaft 111 that simulates a candle body. The socks 153 and 156 may both be made of a woven material that is not air-tight, so that air that passes through the inner sock 156 can inflate the outer sock 153. Alternatively, the outer sock 153 may be more air-tight than the inner sock 156, causing the socks to separate from each other under air pressure from within. Similarly, the outer sock 153 may be made of a solid film such as plastic while the inner sock 156 may be made of a woven material or a perforated solid material. Although two socks are shown to facilitate understanding, more than two socks can be nested in this fashion. It is also possible to provide air to the outer sock 153 that has not passed through the inner sock 156, for example by forcing air into a space between the socks near the base of the pole 160 and socks, through a top portion of the shaft 161. In this case, any of the socks can include solid, perforated or woven material.

The socks 153 and 156 can be different colors from each other, for example, yellow and orange, simulating different layers of a candle flame, and each of the socks can be the same or a different color than the LED 155. One or more of the socks can include fluorescent material that glows in response to receiving radiation from the LED. The socks can also be different colors than traditional candle flame yellow or orange. For example, the socks can be blue, white or green, which may simulate other flames and/or compliment other elements of the illumination device, such as the metal or crystals of a chandelier.

Figure 8:
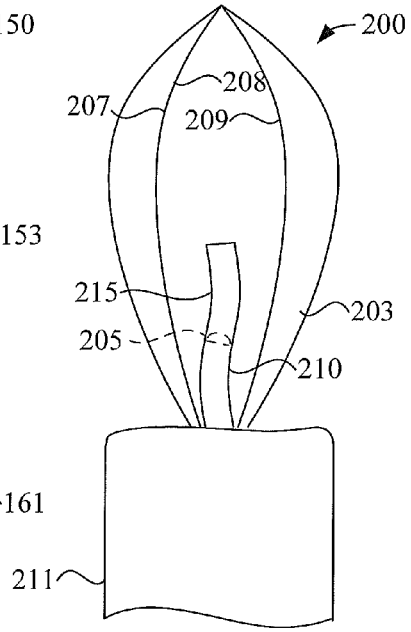
FIG. 8 is a side view of an embodiment of an illumination device that includes a glowing sock that is formed of a plurality of sections that together substantially surround a light source such as a LED.

FIG. 8 is a side view of an embodiment of an illumination device 200 that includes a glowing sock 203 that is formed of a plurality of leaves or sections 207, 208 and 209 that together substantially surround a light source such as a LED 205. In this example, the LED 205 is hidden from view within a pole 210, with a portion 215 of the pole disposed above the LED made of translucent material that redirects the light from the LED so that it appears that the upper portion 215 of the "wick" is glowing. As before, the pole 210 is attached to a shaft 211 that simulates a candle body. The sections 207, 208 and 209 may be made of a woven, solid or perforated material, and each of the sections may be contiguously attached to an adjacent section or adjacent sections may be separated from each other but connected at an end of the sock 203. The separated sections 207, 208 and 209 may overlap each other, and the tips of the sections may be joined together, for example with an adhesive or by sewing. Although three sections 207, 208 and 209 are shown, more or less sections are possible. The sections 207, 208 and 209 may be the same or different colors. As with other embodiments, an upper portion of the sock 203 can have a different color than a lower portion of the sock, for example, yellow and blue, respectively. It is also possible to have one or more other glowing socks nested within sock 203, with the sections of the nested sock preferably offset from the sections of sock 203.

Figure 9:
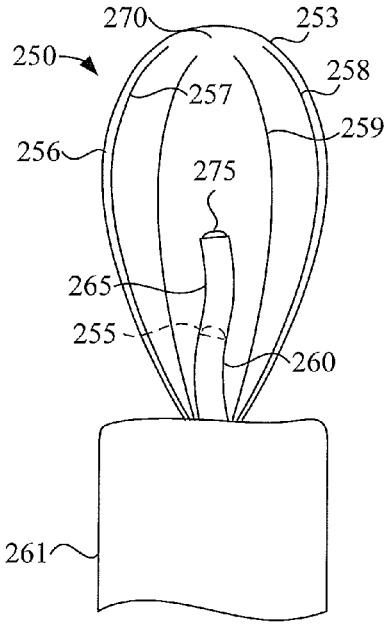
FIG. 9 is a side view of an embodiment of an illumination device that includes a glowing sock that is formed of piece of material that includes a plurality of sections that together substantially surround a light source such as a LED.

FIG. 9 is a side view of an embodiment of an illumination device 250 that includes a substantially egg-shaped glowing sock 253 that is formed of piece of material that includes a plurality of sections 256, 257, 258 and 259 that together substantially surround a light source such as a LED 255. In this example, the LED 255 is hidden from view within a pole 260, with a portion 265 of the pole disposed above the LED made of translucent material that redirects the light from the LED so that it appears that more of the "wick" 260 is glowing. A second LED 275 is disposed near the end of pole 260, and the second LED 275 may have the same or different spectral distribution of emitted radiation as the embedded LED 255. In one embodiment, the second LED 275 may radiate ultraviolet radiation that is not visible but that causes fluorescent material on the flexible sock 253 to glow yellow or orange, for example, while the first LED 255 causes the upper portion 265 of wick 260 to glow red. As before, the pole 260 is attached to a shaft 261 that simulates a candle body. The sections 256, 257, 258 and 259 may be made of a woven, solid or perforated material, and each of the sections may be contiguously attached to an adjacent section or adjacent sections may be separated from each other but connected at the top end of the sock 203. The separated sections 256, 257, 258 and 259 may overlap each other during operation, and the sections may be joined together in an upper region 270.

Figure 10:
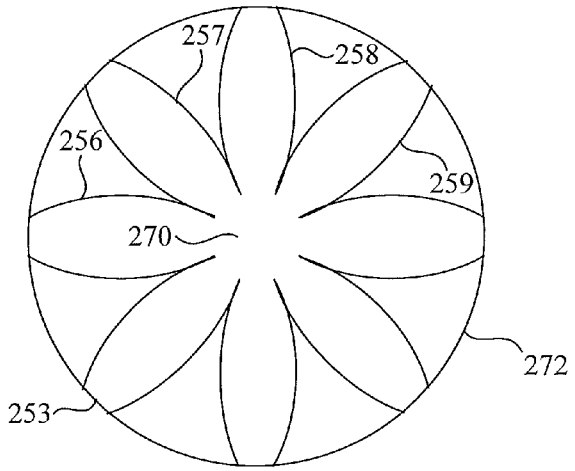
FIG. 10 is a top view of an embodiment of the sock shown in operation in FIG. 9, which may be made from a single piece of material.

As shown in FIG. 10, in one embodiment the sections 256, 257, 258 and 259 of the sock 253 shown in operation in FIG. 9 may be joined together in region 270 because they are all cut from a single piece of material 272. Although eight sections are shown, more or less are possible. The sections 256, 257, 258 and 259 may be the same or different colors. It is also possible to have one or more other glowing socks nested within sock 253, with the sections of the nested sock preferably offset from the sections of sock 253. As before, the sock 253 may transmit, diffuse, reflect and/or refract the radiation from the LEDs 255 and/or 275, and may for example be painted (e.g., sprayed) with fluorescent paint. The material forming the sock 253 may have a shape of a flower, with petals corresponding to sections 256, 257, 258 and 259. Although embodiments of socks may be formed in sections as described above, alternatively such socks may be woven in a desired shape or created on molds of the desired shape that are then removed.

Figure 11:
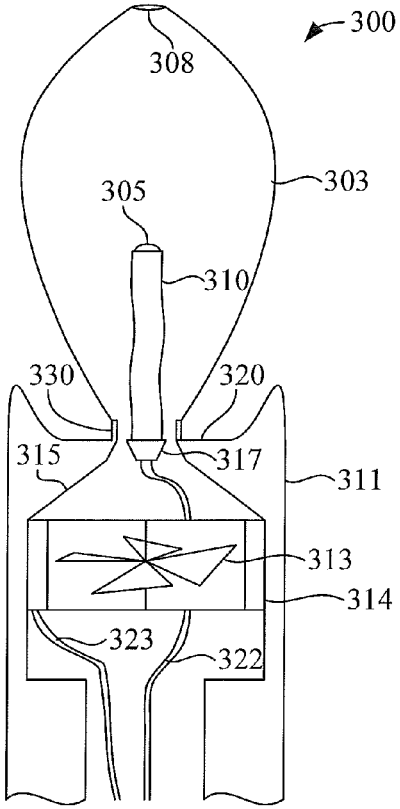
FIG. 11 is an opened-up schematic view of an embodiment of an illumination device having a light source that simulates a lit candle wick, which is attached to a candle shaft that contains a fan which causes a delicate glowing sock that encircles the wick to flutter like a candle flame.

FIG. 11 is an opened-up schematic view of an illumination device 300 having a light source that simulates a lit candle wick, including a LED 305 that is disposed in a pole 310, the light source encircled by a delicate glowing sock 303 that simulates a candle flame. In this embodiment, an air pump or fan 313 is disposed within a shaft 311 that simulates a generally cylindrical wax candle body, the shaft attached to the pole 310 and the sock 313. As one example, the fan can be a conventional, commercially available computer fan having a generally rectangular frame, for instance with dimensions of 25 mm×25 mm×10 mm, such as QwikFlow Series 2510 DC Fans from RedCloud Electronics, Inc., 3400 Industrial Lane, Unit 2, Broomfield, Colo. 80020 (www.qwikflow.com).

The fan 313 may have a substantially square frame 314 that is attached to an interior wall 315 of the shaft 311, within a cavity that accommodates airflow created by the fan. The pole 310 is attached to an axially disposed portion 317 of a recessed region 320 of the shaft 311, the portion 317 attached to the recessed region by radial supports that are not shown in this figure. Leads 322 traverse the portion 317 and pole 310 to provide power to the LED 305, the leads 322 positioned outside the fan case and within the cavity of shaft 311. In an alternative embodiment, leads 322 for an LED 305 can run axially through the center of a fan. A second set of leads 323 provides power to the fan 313. Leads 322 and 323 can alternatively be connected to the conductive threading and tip of an Edison Screw base portion 421 such as that shown in FIG. 13 and FIG. 14, with a fan also disposed within the base portion.

The sock 303 is attached to a lip 330 of the shaft 311, the lip spaced from the pole 310 to allow air propelled by the fan 313 to travel through an aperture in the shaft to inflate and actuate the sock. The shaft cavity is tapered adjacent to portion 317 to funnel air generated by the fan through the aperture at increased velocity and/or pressure. In an alternative embodiment, air from the fan can be funneled through the pole 310 to actuate the sock 303. Having the fan 313 disposed within a cavity of the shaft 311 can reduce the noise generated by the fan. The sock 303 can be similar to any of the socks mentioned in any earlier or later embodiments, and the pole 310 and LED 305 can also be similar to that which is described in any earlier or later embodiments. The sock may have a hole 308 that is slightly larger than the pole 310, so that the pole penetrates the sock and the sock disappears from view when it is not inflated, leaving the pole exposed like an unlit wick.

The current and/or voltage provided to fan 313 can be made to fluctuate, causing the shape of the sock 303 to change and the sock to flicker like a candle flame. In addition, the sock 303 may simply change shape due to outside wind or other forces, again giving the appearance of a flickering candle flame. The current and/or voltage provided to LED 305 can also change, causing the intensity of light from the LED and the sock 303 to change, which may correspond to changes in the shape of the sock.

Figure 12:
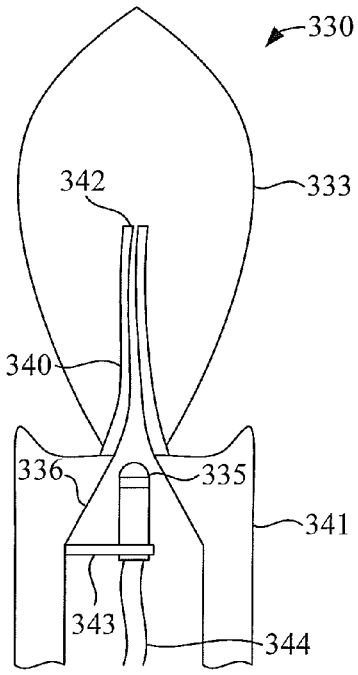
FIG. 12 is a cross-sectional view of an embodiment of an illumination device having a light source including a LED that is disposed within a cavity of a shaft that simulates a wax candle body.

FIG. 12 is a cross-sectional view of an illumination device 330 having a light source including a LED 335 that is disposed within a cavity 336 in a shaft 341 that simulates a wax candle body. The LED 335 is positioned beneath a pole 340 that acts as a conduit for air and light from the LED. When the LED 335 is illuminated, the pole 340 simulates a glowing candle wick, which is substantially surrounded by a delicate glowing sock 333 that simulates a candle flame when air is forced through the pole. A source of air pressure and/or flow, such as an air pump and/or fan, is in fluid communication with the cavity 336. The cavity 336 is tapered adjacent to the LED 335, as is the hollow interior of the pole 340, to increase the pressure and velocity of the air being ejected from a tip 342 of the pole. Both the candle shaft 341 and the pole act as a nozzle for the air, which can convert a small air pressure and slow air flow within relatively wide portions of the cavity 336 into turbulent flow of air ejected from the tip 342. Such a turbulent air flow can cause the glowing sock 333 to flutter, giving it the appearance of a flickering candle flame.

The pole 340 may be made of a material such as plastic or glass that refracts, diffuses and transmits light, and may for example include fluorescent material. The pole 340 may have a coating that surrounds its lower portion and which reflects light, so that only the upper portion glows. Such a reflective coating may itself be coated with a non-reflective coating so that the lower portion of the pole 340 does not appear shiny. In this case the lower portion may be transparent and the upper portion cloudy to diffuse the light from the LED 335. Additional holes may be provided in the pole 340 or shaft 341 to provide air that actuates the delicate glowing sock 333.

One or more supports 343 hold the LED 335 within the shaft 341, and leads 344 for the LED are connected to a power source, not shown in this figure. Additional LEDs can be held in within the cavity 336. Also, the support can be attached to a frame of a fan such as shown in FIG. 11.

In an alternative embodiment an illumination device may include a fan such as that depicted in FIG. 11 with a least one LED mounted on the frame of the fan to illuminate a wick-like pole such as shown in FIG. 12, which can serve as a conduit for light and air from the fan. In this example, the fan blades, rotor and shaft cavity may be made of or painted with material that reflects the LED light, and the cavity may be cone-shaped to direct the LED light into the wick-like pole. As an example, two diagonally opposed bolt holes in a square fan frame that are designed for mounting the frame can instead be used for holding LEDs, with the other two diagonally opposed bolt holes are used to bolt the frame to the candle shaft.

In an alternative embodiment an illumination device may include a shaft cavity such as that depicted in FIG. 11 or FIG. 12 with a least one LED provided in the cavity to illuminate a delicate sock such as shown in FIG. 11 or FIG. 12, without a pole that serves as a conduit for air and/or light. The pole can be absent or, alternatively, provided in a form that does not transmit air or light, e.g., as a black solid pole that simulates a burnt candle wick. In the latter case, the sock may have a hole like hole 308 in FIG. 11, so that the sock disappears from view when it is not inflated, leaving the burnt wick exposed.

Figure 13:
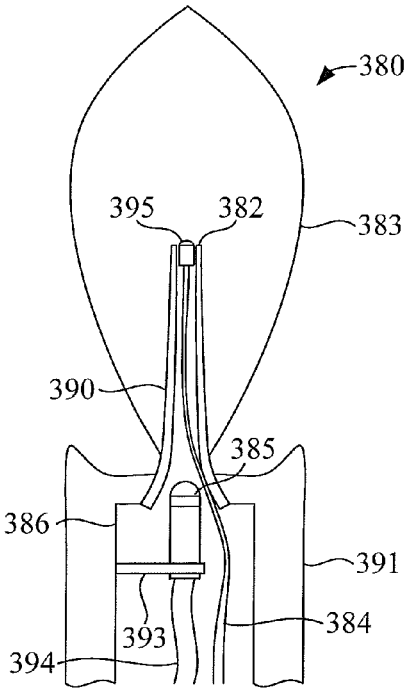
FIG. 13 is a cross-sectional view of an illumination device having a light source including a first LED that is disposed within a cavity in a shaft that simulates a wax candle body and a second LED that is disposed near a tip of a pole that simulates a candle wick.

FIG. 13 is a cross-sectional view of an illumination device 380 having a light source including a LED 385 that is disposed within a cavity 386 in a shaft 391 that simulates a wax candle body. The LED 385 is positioned beneath a pole 390 that acts as a conduit for air and light from the LED. A second LED 395 is disposed near a tip 382 of the pole 390, with leads 384 for LED 395 disposed within the pole, so that the pole also serves as an electrical conduit for that LED. Openings between the second LED 395 and the tip 382 serve as nozzles through which air from within the shaft and the pole can flow.

When the LED 385 is illuminated, the pole 390 simulates a glowing candle wick, which is substantially surrounded by a delicate glowing sock 383 that simulates a candle flame when air flows through the pole. A source of air pressure and/or flow, such as an air pump and/or fan, is in fluid communication with the cavity 386. The cavity 386 is tapered adjacent to the LED 385, as is the hollow interior of the pole 390, to increase the pressure and velocity of the air being ejected from the tip 382 of the pole. The cavity 386, the pole 390 and the opening or openings at the tip 382 act as a nozzle for the air, which can convert a small air pressure and slow air flow within relatively wide portions of the cavity 386 into turbulent flow of air ejected from the tip 382. Such a turbulent air flow can cause the glowing sock 383 to flutter, giving it the appearance of a flickering candle flame.

The pole 390 may be made of a material such as plastic or glass that refracts, diffuses and transmits light from LED 385, and may for example include fluorescent material. The pole 390 may have a coating that surrounds its lower portion and which reflects light, so that only the upper portion glows. Such a reflective coating may itself be coated with a non-reflective coating so that the lower portion of the pole 390 does not appear shiny. In this case the lower portion may be transparent and the upper portion cloudy to diffuse the light from the LED 385. Additional holes may be provided in the pole 390 or shaft 391 to provide air that actuates the delicate glowing sock 383. One or more supports 393 hold the LED 385 within the shaft 391, and leads 384 and 394 are connected to a power source, not shown in this figure.

LED 385 and LED 395 can emit the same or a different spectrum of light. For example, LED 385 can emit primarily red or orange light and LED 395 can emit primarily yellow or orange light. Alternatively, LED 385 can emit primarily red or orange light and LED 395 can emit blue or ultraviolet light that is reradiated by a fluorescent material of the flexible sock, which may for example be colored yellow. As another example, with the sock 383 stained with a fluorescent yellow material that absorbs and reradiates yellow and higher frequencies of light, LED 385 and/or LED 395 can emit white light that makes the sock glow yellow while the pole 390 and/or its tip 382 can appear from outside the sock to be red or orange, lower frequency colors which are not absorbed by the sock. Similarly, sock 383 can be stained with a fluorescent yellow paint that absorbs and reradiates yellow and higher frequencies of light, LED 385 and/or LED 395 can emit a spectrum of light having a yellow peak intensity, which makes the sock glow yellow while the pole 390 and/or its tip 382 can appear to be orange, a color which is emitted by LED 385 and/or LED 395 at a lower intensity and not absorbed by the sock.

Figure 14:
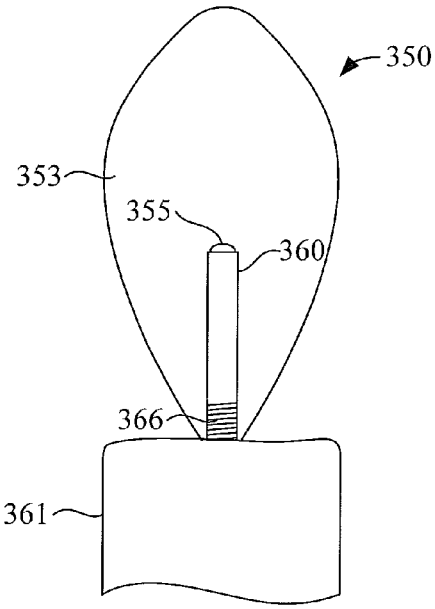
FIG. 14 is a side view of an embodiment of an illumination device that includes a flexible magnetized sock that substantially surrounds a light source such as a LED and a solenoid that can be used to move the sock while it glows.

FIG. 14 is a side view of an embodiment of an illumination device 350 that includes a substantially ellipsoidal flexible glowing sock 353 that is operationally coupled to a light source such as a LED 355 held by a pole 360 designed to look like a candle wick. The "wick" 360 is attached to a generally cylindrical shaft 361 that is designed to look like a wax body of a candle. Encircling the pole 360 adjacent to the shaft 361 is a conductive coil or solenoid 366, which can be used to move the sock 353. The sock 353 includes magnetic material that has been magnetized so that it is attracted to or repulsed by the coil 366, depending upon the direction of electric current in the coil. The magnetic moment of the magnetic material may be set by coil 366 or by another magnet by applying a field sufficient to magnetize the material, after which the solenoid 366 can actuate the sock 353 with a lower strength field that does not change the moment.

Magnetic material may be provided to the sock 353 in various ways. In one embodiment, magnetic paint is applied to the sock, after which the magnetic moment of the sock is set. Magnetic paint is commercially available, for example, from www.magnamagic.com, www.krylon.com or www.abcstuff.com. Magnetic particles, which may be called magnetic paint additive, can be added to paint or otherwise adhered to the sock, and can be obtained for example from Magically Magnetic Inc., P.O. Box 219, Saxonburg, Pa. 16056. In one embodiment, a fluorescent paint is sprayed on what will become an interior surface of the sock, after which magnetic particles can be dusted on. The magnetic particles may be evenly distributed or may be concentrated, for example, in an upper region of the sock. Current in the solenoid 366 may be temporarily reversed to deflate the sock 353, or the sock may simply collapse under the force of gravity when the current is off.

The current in coil 366 can be made to fluctuate, causing the shape of the sock 353 to change and the sock to flicker like a candle flame. In addition, the sock may simply change shape due to wind or other forces, again providing the appearance of a flickering candle flame. The current and/or voltage provided to LED 355 can also change, causing the intensity of light from the LED and the sock 353 to change, which may correspond to changes in the shape of the sock.

Figure 15:
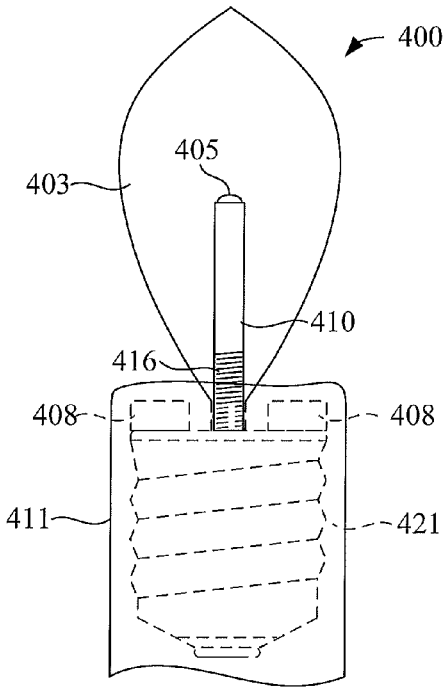
FIG. 15 is a side view of an embodiment of an illumination device similar to that depicted in FIG. 14 with a standard fitting such as an Edison Screw that allows the illumination device to serve as an easily implemented replacement for light bulbs.

FIG. 15 is a side view of an embodiment of an illumination device 400 that includes a flexible glowing sock 403 that is operationally coupled to a light source such as a LED 405 held by a pole 410 designed to look like a candle wick. The illumination device 400 in this embodiment includes a conductive threaded base portion 421 that is designed to screw into a conductive threaded socket in the shaft 411. The base portion 421 and the socket may both correspond to a standard fitting size such as an "Edison Screw" E10, E11, E12, E14, E17, E26, E27, E29, E39 or E40. Alternatively, such an illumination device can be made with a standard two-pronged "Bayonet Cap" fitting, such as BC or B22. Providing an illumination device with such standard fittings allows the illumination device to serve as an easily implemented replacement for light bulbs.

Much as before, the "wick" 410 is attached to a generally cylindrical shaft 411 that is designed to look like a wax body of a candle. Encircling the pole 410 adjacent to the shaft 411 is a conductive coil or solenoid 416, which can be used to move the sock 403. The sock 403 includes magnetic material that has been magnetized so that it is attracted to or repulsed by the coil 416, depending upon the direction of electric current in the coil. The magnetic moment of the magnetic material may be set by coil 416 or by another magnet by applying a field sufficient to magnetize the material, after which the solenoid 416 can actuate the sock 403 with a lower strength field that does not change the moment.

The base 421 may have an electrically insulating upper surface that is recessed compared to an upper edge of the shaft 411, which allows the sock to fall out of view when it is not repulsed by the magnetic field from the solenoid 416. Although the coil 416 is shown as extending above the upper edge of the shaft 411, the coil may instead also be recessed compared to that upper edge. Alternatively, the coil 416 may continue further up the pole 410, and may encircle the entire pole. Two radially aligned fins 408 are provided as an aid for screwing the base portion 421 into and out of the socket.

Figure 16:
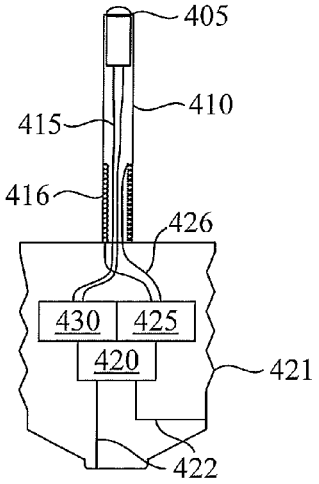
FIG. 16 is a schematic view of a part of the illumination device of FIG. 15.

FIG. 16 is a schematic view of part of the illumination device 400 of FIG. 15. A first pair of electrical leads 422 are connected between the threaded base 421 and a first electronic circuit 420. The first electronic circuit 420 may include a mechanism to split the current from leads 422 into current that is provided to the LED 405 and current that is provided to the solenoid 416, or the LED and solenoid may be connected in series. First electronic circuit 420 may also include a rectifier, diode or AC/DC converter for the situation in which the current in leads 422 is alternating. First electronic circuit 420 may also include a voltage divider for the situation in which the voltage between leads 422 is too high for use by LED 405 or solenoid 416. In addition, first electronic circuit 420 may include a mechanism that varies the voltage and/or current provided to solenoid 416 and/or LED 405, in an attempt to simulate the appearance of a flickering candle flame.

Many such mechanisms can be found in the myriad patents and applications that attempt to teach how to simulate a candle flame, although those mechanisms may be primarily directed to changing the intensity of an electrically powered light rather than changing the shape of a gossamer sock. For example, U.S. Pat. Nos. 4,492,896, 4,510,556, 4,593,232, and 5,097,180, the teachings of which are incorporated by reference herein, disclose mechanisms that would be known to one of ordinary skill in the art.

Digressing for the moment to discuss mechanisms for embodiments having groups of artificial candles which may be found in an illumination device such as a chandelier, individual glowing socks can change their shape in a pattern relative to the other socks, with a microcontroller or microprocessor disposed in the chandelier body and programmed to orchestrate the actuation of the group. For example, individual glowing socks can be actuated in a wave-like fashion that sweeps across the chandelier like a wind from the side. As another example, individual glowing socks that are disposed at the same distance from a vertical axis of the chandelier can be actuated simultaneously, with others socks positioned at a different distance from the axis actuated simultaneously with each other but at a different time from the first socks, like ripples spreading out on a pond. In another example, the glowing socks can be actuated in a pattern that circles around the chandelier like a rotating wheel. Different or random patterns may alternatively be employed for actuating groups of artificial candles.

A second electronic circuit 425 is connected between the first electronic circuit 420 and leads 426 for the solenoid 416. The second electronic circuit 425 may contain a voltage divider to lower the voltage provided to solenoid 416, and may also include a rectifier or diode. Second electronic circuit 425 may also contain a mechanism that varies the voltage and/or current provided to solenoid 416, causing the sock to flutter like a flickering candle flame.

A third electronic circuit 430 is connected between the first electronic circuit 420 and leads 415 for the LED 405. The third electronic circuit 430 may contain a voltage divider to lower the voltage provided to LED 405, and may also include a rectifier or diode. Third electronic circuit 430 may also contain a mechanism that varies the voltage and/or current provided to LED 405, in an attempt to simulate the appearance of a flickering candle flame.

Alternatively, electronics similar or equivalent to that described for first, second and third electronic circuits may be disposed in a location remote from the LED 405 and/or solenoid 416. For example, a chandelier that has electrical wiring for incandescent light bulbs can be fitted with an adapter that converts single or two phase alternating current (e.g., 110V or 220V) to direct current of 5V, 12V or another amount designed to power the LED 405 and the solenoid 416. Such an adapter can be disposed, for instance, in the body 40 or mounting apparatus 46 of the chandelier 30 shown in FIG. 1. Because the wiring in this case has been over-engineered to handle much higher voltage and current than the single or double digit DC voltage output by the adapter, little resistance and corresponding voltage and current drop would be expected at the LED 405 compared to the adapter. For the situation in which the LED 405 is designed to run on a different voltage or current than the solenoid 416, appropriate voltage and current dividers can be provided in the first, second or third electronic circuits to convert the electrical power as needed.

Figure 17:
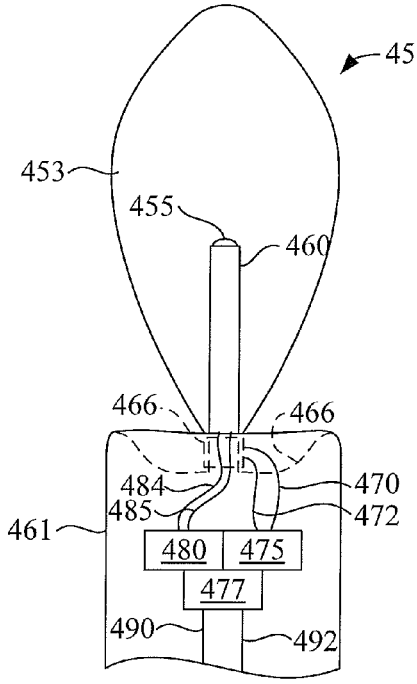
FIG. 17 is a side view of an embodiment of an illumination device that includes a flexible conductive sock that substantially surrounds a light source such as a LED and is connected to an electrical lead that can be used to move the sock while it glows.

FIG. 17 is a side view of an embodiment of an illumination device 450 that includes a flexible glowing sock 453 that is operationally coupled to a light source such as a LED 455 held by a pole 460 designed to look like a candle wick. The "wick" 460 is attached to a generally cylindrical shaft 461 that is designed to look like a wax body of a candle. The shaft 461 has a recessed portion 462 that appears as though wax adjacent to the "wick" 460 has melted away, and also provides a receptacle that holds the sock 453 when it is deflated. The sock 453 includes conductive material that carries an electric charge that causes different portions of the sock to be repulsed from each other, thereby inflating the sock. Encircling the pole 460 adjacent to the shaft 461 is a conductive collar or clamp 466, which is connected to a lead 470 that can provide voltage that is used to actuate the sock 453. Another lead 472 is also connected to the collar 466, which may be essentially an open circuit during actuation but can later be used to deflate the sock 453 by bleeding charge from the sock.

Conductive material may be provided to the sock 453 in various ways. In one embodiment, conductive paint may be applied to the sock, which may include a woven or solid, natural or synthetic material that is otherwise not conductive. Conductive paint is commercially available, for example, from LessEMF.com, 809 Madison Avenue, Albany, N.Y. 12208, in the form of "STATICFLEX™ Flexible Conductive Paint." In one embodiment, the sock can be fabricated from conductive fabric or cloth. Conductive fabric or cloth is commercially available, for example, from the Zippertubing Co., 13000 South Broadway, Los Angeles, Calif. 90061, in the form of Z-Cloth®, for example, product number Z-3250-CN. Another type of conductive cloth that is commercially available and may be used to form sock 453 is silk organza, which contains silk thread wrapped in thin copper foil. Silk organza traditionally includes conductive thread in one direction, whereas it may be preferable to use a fabric for the sock that has conductive threads disposed in two, generally orthogonal directions, the conductive threads made for instance of silk, nylon or rayon wrapped in copper foil. Flexible transparent conductors that can be used to make conductive sock 453 may also be available in the form of carbon nanotubes from Advance Nanotech, Inc. Any of these woven fabrics can be painted with fluorescent or other paint, for example by spraying.

The voltage provided to collar 466 can be made to fluctuate, causing the shape of the sock 453 to change and the sock to flicker like a candle flame. In addition, the sock may simply change shape due to wind or other forces, again giving the appearance of a flickering candle flame. The current and/or voltage provided to LED 455 can also change, causing the intensity of light from the LED and the sock 453 to change, which may correspond to changes in the shape of the sock.

In one embodiment, a first electrical circuit 475 is connected to leads 470 and 475 to actuate the sock 453: When inflation of the sock 453 is desired, lead 470 is at least temporarily connected to a high voltage source and lead 472 is disconnected from ground so that the sock may be charged. Lead 470 may then be disconnected from the voltage source so that a person that touches the sock 453 will only receive the charge that is held on the sock, much like the shock felt from a discharge of static electricity acquired by shuffling shoes on a carpet. In one embodiment, first electrical circuit 470 may contain a capacitor that acts as the voltage source for charging the sock 453, and switches that provide a set of different states. In the first state, the capacitor is charged by a connection to a voltage source, but the capacitor is not connected to the sock 453 by lead 470. In the second state, the capacitor is disconnected from the voltage source and is connected to the sock 453 by lead 470, while lead 472 is disconnected from ground, inflating the sock. In the third state, the capacitor may be disconnected from the voltage source and is disconnected from sock 453, while lead 472 is connected to ground, deflating the sock. Alternatively, in the third state the capacitor may be connected to the voltage source while disconnected from sock 453, similar to the first state. Other mechanisms may alternatively be employed to provide charge to the sock 453.

A second electronic circuit 477 is connected between first electronic circuit 475 and leads 490 and 492. Leads 490 and 492 may for example carry household alternating current at 110V or 220V. The second electronic circuit 477 may contain a voltage sensor that determines when power is turned on and turned off in leads 490 and 492. A signal from the sensor can be sent to first electronic circuit 475 to switch that circuit between states, thereby actuating the sock. The second electronic circuit 477 may contain a rectifier or AC/DC converter that provides only positive or only negative voltage to the first electronic circuit 475, for charging the capacitor. The second electronic circuit 477 may also contain a current splitter that divides the current between the first electronic circuit 475 and a third electronic circuit 480.

The third electronic circuit 480 may contain one or more voltage dividers to lower the voltage provided by leads 484 and 485 to the LED 455. For the situation in which rectified but not direct current is provided to the third electronic circuit 480, the voltage dividers may include an inductor. Alternatively, relatively low voltage direct current can be provided to LED 455 separately from the higher voltage leads that may charge the sock 453, for example from an adapter disposed in a central body of a chandelier.

Figure 18:
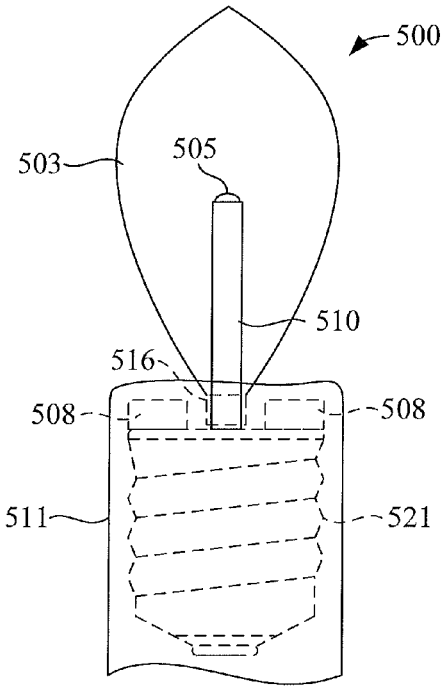
FIG. 18 is a side view of an embodiment of an illumination device that includes a flexible, glowing, electrically conductive sock that is operably coupled to a light source such as a LED held by a pole designed to look like a candle wick, the illumination device including a conductive threaded base portion that is designed to screw into a conductive threaded socket in s shaft that simulates a wax candle body.

FIG. 18 is a side view of an embodiment of an illumination device 500 that includes a flexible, glowing, electrically conductive sock 503 that is operationally coupled to a light source such as a LED 505 held by a pole 510 designed to look like a candle wick. The illumination device 500 in this embodiment includes a conductive threaded base portion 521 that is designed to screw into a conductive threaded socket in a shaft 511 that simulates a wax candle body. The base portion 521 and the socket may both correspond to a standard fitting size such as an "Edison Screw" E10, E11, E12, E14, E17, E26, E27, E29, E39 or E40. Alternatively, such an illumination device can be made with a standard two-pronged "Bayonet Cap" fitting, such as BC or B22. Providing an illumination device with such standard fittings allows the illumination device to serve as an easily implemented replacement for light bulbs.

Much as before, the sock 503 includes conductive material that carries an electric charge that causes different portions of the sock to be repulsed from each other, thereby inflating the sock. Encircling the pole 510 adjacent to the shaft 511 is a conductive collar or clamp 516, which is connected to a lead that can provide voltage that is used to actuate the sock 453. Another lead is also connected to the collar 466, which may be an open circuit during actuation but can later be connected to ground and used to deflate the sock 453 by bleeding charge from the sock. A plurality of radially aligned fins 508 are provided as an aid for screwing the base portion 521 into and out of the socket.

Figure 19:
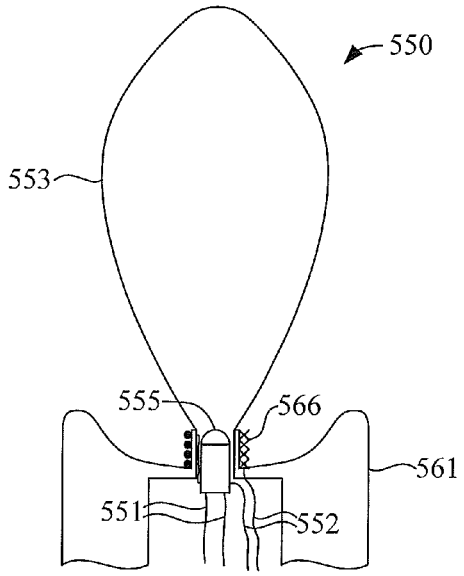
FIG. 19 is a cross-sectional view of an embodiment of an illumination device that includes a flexible, glowing, magnetized sock that is operationally coupled to a light source such as a LED and an actuator such as a solenoid, and which does not have a pole designed to look like a candle wick.

FIG. 19 is a cross-sectional view of an embodiment of an illumination device 550 that includes a flexible, glowing, magnetized sock 553 that is operationally coupled to a light source such as a LED 555 and an actuator such as electrical coils or solenoid 566. This embodiment does not have a pole designed to look like a candle wick, so that when the sock 553 is deflated the illumination device has the appearance of a candle having a wick that has burned below an upper edge of the shaft 361. Alternatively a flexible glowing tube that simulates a candle wick can be provided, the tube being magnetized at least at its tip to be actuated by the solenoid 566. When solenoid is turned off the tube as well as the sock collapse to simulate a candle having a wick that has burned below an upper edge of the shaft 361.

Figure 20:
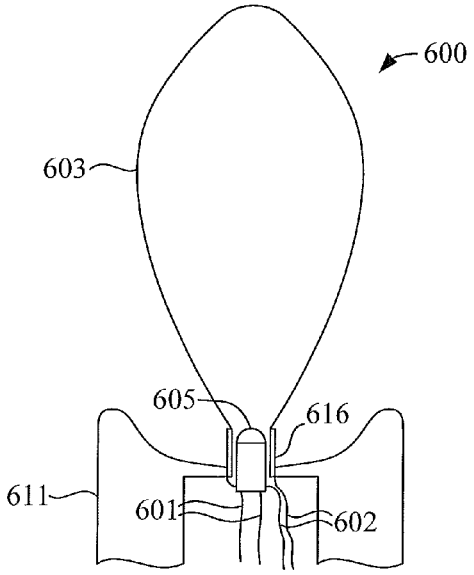
FIG. 20 is a cross-sectional view of an embodiment of an illumination device that includes a flexible, glowing, electrically conductive sock that is operationally coupled to a light source such as a LED, and which does not have a pole designed to look like a candle wick.

FIG. 20 is a cross-sectional view of an embodiment of an illumination device 600 that includes a flexible, glowing, electrically conductive sock 603 that is operationally coupled to a light source such as a LED 605. The electrically conductive sock 603 is also connected to a collar 616 that is electrically conductive on an interior surface that contacts the sock 603 electrically insulating on its exterior surface. Electrical leads 602 are connected to collar 616 to actuate the sock 603. This embodiment does not have a pole designed to look like a candle wick, so that when the sock 603 is deflated the illumination device has the appearance of a candle having a wick that has burned below an upper edge of the shaft 611. Alternatively a flexible glowing tube that simulates a candle wick can be provided, the tube being electrically conductive to be actuated by the leads 602 along with the sock. When the electrical charge is removed the tube as well as the sock collapse to simulate a candle having a wick that has burned below an upper edge of the shaft 361.

Figure 21:
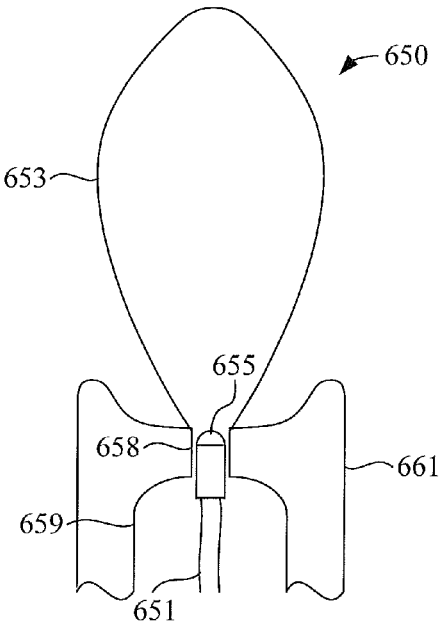
FIG. 21 is a cross-sectional view of an embodiment of an illumination device that includes a flexible, glowing sock with an interior surface that is illuminated by a light source such as a LED, the sock being operably coupled to an actuator such as a fan or air pump, and which does not have a pole designed to look like a candle wick.

FIG. 21 is a cross-sectional view of an embodiment of an illumination device 650 that includes a flexible, glowing, sock 653 with an interior surface that is illuminated by a light source such as a LED 655. The LED 655 is held by at least one support that is not visible in this cross-section in an axially disposed aperture 658 of a shaft 661 that is designed to simulate a wax candle body. The aperture 658 is connected to a cavity 659 in the shaft 661 which is in fluid communication with a fan or air pump that can inflate or otherwise change the shape of the sock 653. This embodiment does not have a pole designed to look like a candle wick, so that when the sock 653 is deflated the illumination device has the appearance of a candle having a wick that has burned below an upper edge of the shaft 361.

Figure 22:
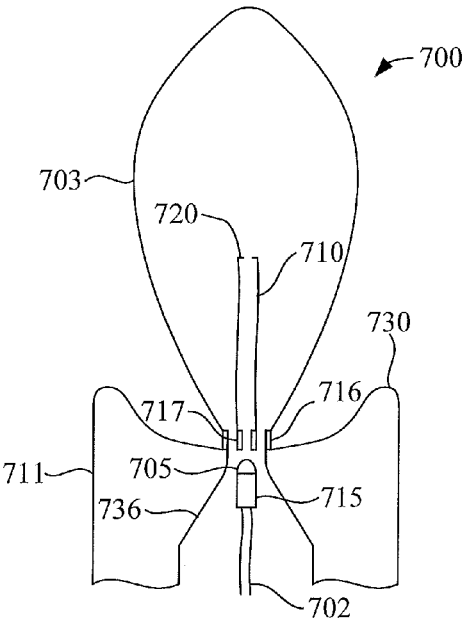
FIG. 22 is a cross-sectional view of an embodiment of an illumination device that includes a flexible, glowing shroud and a flexible, glowing pole, both of which are illuminated by a light source such as a LED.

FIG. 22 is a cross-sectional view of an embodiment of an illumination device 700 that includes a flexible, glowing sock 703 and a flexible, glowing pole 710, both of which are illuminated by a light source such as a LED 705. The LED 705 is disposed in a funnel-shaped cavity 736 of a shaft 711 that is designed to simulate a wax candle body, and has a body 715 that is held by at least one support that is not visible in this cross-section. The LED 705 and the cavity 736 may be axially disposed within the shaft 711, with the cavity 736 in fluid communication with a fan or air pump that can inflate or otherwise change the shape of the sock 703 and pole 710. Leads 702 provide power to the LED 705, which may coincide with inflation and actuation of the pole 710 and sock 703. When the sock 703 and pole 710 are deflated the illumination device has the appearance of a candle having a wick that has burned below an upper edge 730 of the shaft 711.

The pole 710 in this embodiment can be made of thin flexible material such as woven nylon or silk or a plastic film, which may be perforated with holes. The pole 710 may be a simple tube, or a hole may be located in a tip 720 of the pole, or the tip may be formed of a solid film with woven material at the tip. At least an upper portion of the flexible pole 710 may be stained with fluorescent dye, for example colored red, while at least an upper portion of the flexible the sock 703 may be stained with another fluorescent dye, for example colored yellow.

A pair of concentric rings 716 and 717 are attached to the shaft 711 at a mouth of the cavity 736, and attached to each other with a plurality of radial bars, not shown in this cross-section. A base of the sock 703 is attached to outer ring 716 and a base of the pole 710 is attached to inner ring 717. The space between the rings 716 and 717 allows air and light to be provided to the sock 703 which have not passed through the pole 710. The rings 716 and 717 may have a reflective surface and the bars may be transparent, to transmit light from the LED 705 to the sock 703 and pole 710. Both pole 710 and sock 703 can include solid, perforated or woven material.

Alternatively, the sock 703 and pole 710 can be attached to the shaft in a manner similar to that shown in FIG. 12, so that all the air in the sock has passed through the pole. In this case, the pole 710 and sock 703 may both be made of a woven material that is not air-tight, so that air that passes through the pole 710 can inflate the sock 703, even when the pole has little or no hole at its tip. Alternatively, the sock 703 may be more air-tight than the pole 710, causing the sock and pole to separate from each other under air pressure from within. Similarly, the sock 703 may be made of a solid film such as plastic while the pole 710 may be made of a woven material or a perforated solid material. For a low pressure and/or low air flow embodiment, both pole 710 and sock 703 may be made of a solid substantially air-tight film, with a pin hole at the tip of the pole allowing air to inflate the sock 703.

Figure 23:
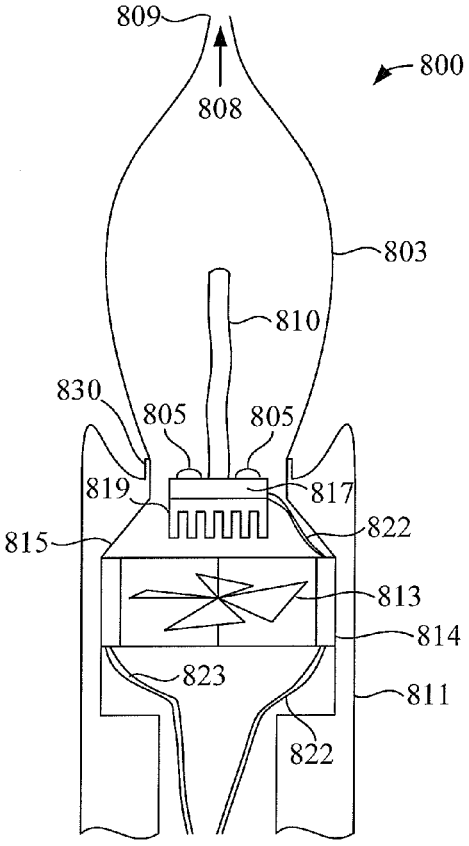
FIG. 23 is an opened-up schematic view of an embodiment of an illumination device having a light source including a plurality of LEDs, which illuminate a flexible shroud and a pole.

FIG. 23 is an opened-up schematic view of an embodiment of an illumination device 800 having a light source including a plurality of LEDs 805, which illuminate a flexible shroud 803 and a pole 810. The pole 810 is coated in an upper portion with red or orange paint, which may be fluorescent, to simulate a glowing candle wick. The light emitted from LEDs 805 illuminates the shroud 803, so that the shroud emits light while changing shape due to airflow, simulating a candle flame. In this embodiment, a mechanism that provides airflow such as a fan 813 is disposed within a shaft 811 that simulates a generally cylindrical wax candle body, the fan forcing air into the shroud 803, with air exiting the shroud at an aperture 808 at a tip 809 of the shroud.

The pressure of the air exiting through aperture 808 may cause the tip 809 of the shroud 803 to wave around, like the end of a garden hose that snakes around due to the pressure of water shooting through it. This waving motion of the tip of the glowing shroud 803 simulates the flickering of a candle flame. As discussed above, the shroud may contain fluorescence material, such as phosphor particles, that emit light of a different frequency than that emitted by the LEDs 805. For example at least one of the LEDs may emit blue light, some of which passes through the shroud 803 and some of which is reradiated by the shroud as yellow light.

In this example, four LEDs 805 are disposed in a square pattern on a substrate 817 that may be in contact with an optional heat sink 819. The fan 813 blows air on the substrate 817 and/or heat sink 819, which cools the substrate. More or less LEDs may be used, and various heat sink designs are possible. The substrate may be ceramic, and may in an embodiment be a chip on which the LEDs were formed. The substrate may alternatively be a printed circuit board or made of heat-conductive metal, as known in the art. In another embodiment, a plurality of discrete LEDs may be used without an adjoining substrate.

Unfortunately, conventional LEDs that have heat sinks attached may be more unattractive than conventional incandescent light bulbs, due to the bulky metal protrusions of the heat sinks. Moreover, such heat sinks may be rendered ineffective within a closed container, because the air within the container increases in temperature due to heat from the heat sink, so that enclosing the ugly heat sinks would be disfavored. In contrast, embodiments of the present disclosure provide air flow that cools the LEDs while shielding any fans, heat sinks or the like from view. In addition, the air flow may animate a shroud that simulates a candle flame.

In one example, the substrate 817 and heat sink 819 may be attached to the shaft 811 with a plurality of substantially radial arms, not shown, and the pole 810 may be attached to the shaft with the same or different arms. In another example, the substrate 817 and heat sink 819 may be attached to the shaft 811 with a plurality of substantially radial fins of the heat sink. Although the pole 810 is shown adjoining an axial portion of the substrate 817, the pole may be separated from the substrate, for example by the arms that hold the pole or by a cover over the LEDs 805, not shown. Any arms that hold the pole 810 or LEDs should be positioned to avoid obstructing light from the LEDs 805. The fan 813 in this example has a frame 814 that is attached to the interior wall 815 of the shaft 811, within a cavity that accommodates airflow created by the fan. Leads 822 provide power to the LEDs 805 on substrate 817. The leads 822 may be positioned outside the fan case and within the cavity of shaft 811. The shaft 811 may have at least one opening near its base to allow air to flow into the cavity housing the fan 813.

The shroud 803 may be attached to an annular lip 830 of the shaft 811, the lip spaced from the substrate 817 to allow air propelled by the fan 813 to travel through an aperture in the shaft to inflate and/or animate the shroud. The shaft 811 cavity may be tapered adjacent to substrate 817 to funnel air generated by the fan through the aperture at increased velocity and/or pressure. The shroud 803 can be similar to the shrouds or socks described in other embodiments, and the pole 810 and LEDs 805 can also be similar to the poles and LEDs described in other embodiments.

Figure 24:
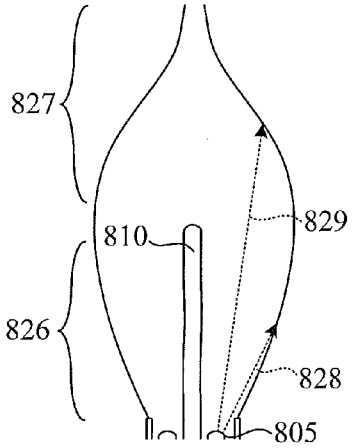
FIG. 24 is a cross-sectional view of the device of FIG. 23 in which light is transmitted from an upper portion of the shroud much more than from a lower portion of the shroud.

In an embodiment shown in FIG. 24, the device 800 is configured so that light from at least one LED 805 impinges upon an upper portion 827 of the shroud while a lower portion 826 of the shroud is not illuminated by the LED, or is illuminated very much less. For example, the lower portion 826 may increase in diameter with increasing height, so that light 828 from LED 805 is nearly parallel with the lower portion of the shroud. In contrast, the upper portion 827 may decrease in diameter with increasing height, so that light 829 from LED 805 impinges upon the upper portion of the shroud more directly, for example at an angle from the surface of the shroud that is at least twice and may be more than five or ten times as large as than the angle light 828 makes with the shroud surface. The upper portion 827 may be illuminated by LEDs 805 much more intensely than the lower portion 826, so that the upper portion transmits much more light than the lower portion, simulating a candle flame that hovers over a surface of the candle. For example, at least four times more of the light may be transmitted from an upper half of the shroud than from a lower half of the shroud.

In one embodiment a fluorescent material such as phosphor particles may be disposed at a higher concentration in an upper portion of a shroud than in a lower portion of the shroud. In this case, the upper portion may emit much more light than the lower portion, simulating a candle flame that hovers over a surface of the candle, even if the upper portion is illuminated by LEDs at about the same intensity as the lower portion. Of course, as with the remainder of this disclosure, it is possible to combine aspects so that an upper portion of a shroud may have both a higher concentration of phosphor particles and be illuminated by a higher intensity of electromagnetic radiation, in which case the upper portion may emit much more light than the lower portion.

A low (or nonexistent) angle between the light 828 and the shroud surface in the lower portion 826 may accentuate a waving motion of the shroud, especially for the situation in which the shroud includes fluorescent material, as small movements of the shroud shift it between light and shadow. For example, slight travelling waves in the shroud caused by airflow can appear as rolling waves of fluorescing material that simulate flames traveling upward. Moreover, light from LEDs 805 that passes through aperture 808 unimpeded by the shroud 803 can create a pattern that moves across a ceiling or through a dangling crystal as the shroud tip wiggles, providing a different flickering effect.

Figure 25:
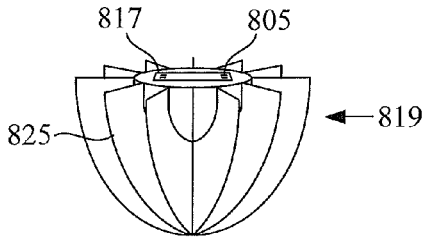
FIG. 25 is a perspective view of an example of a heat sink that may be attached to the chip or substrate shown in FIG. 23 holding LEDs.

FIG. 25 is a perspective view of an example of a heat sink 819 that may be attached to the chip or substrate 817 holding LEDs 805, shown in FIG. 23. The heat sink 819 may be made of a metal that is a good heat conductor, such as copper or aluminum, and in this example has a number of fins 825 that radiate heat from the substrate. Outer portions of fins 825 may be attached to the interior wall 815 of the shaft 811, so that air can flow past the fins to actuate the shroud 803. Electrical power to the LEDs 805 may be provided by circuit traces on the substrate 817 or leads bonded to upper surfaces of LEDs, not shown, which are connected to leads 822.

Figure 26:
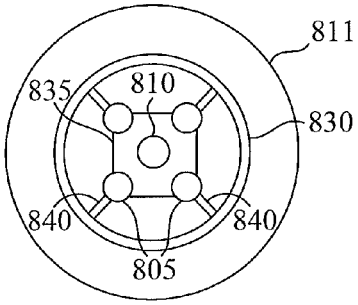
FIG. 26 is a top view of an illumination device similar to that shown in FIG. 23, with the shroud removed.

FIG. 26 is a top view of an illumination device similar to that shown in FIG. 23, with the shroud 803 removed. In this example, a plurality of discrete LEDs 805 are attached to a support 835 that also holds the pole 810. Support 835 includes a plurality of arms 840 that are attached to the shaft 811 at or near the lip 830. A plurality of voids between the arms 840 allow air to flow into the shroud, not shown in this figure.

Figure 27:
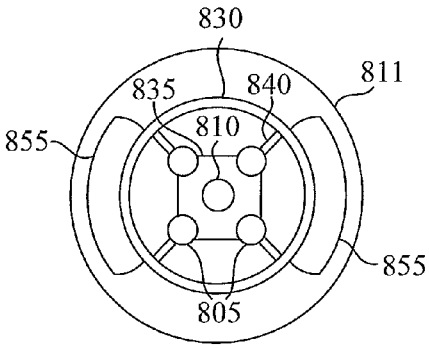
FIG. 27 is a top view of an illumination device similar to that shown in FIG. 26, with a plurality of openings near the lip that allow air to enter the shaft, for an example in which the shaft does not have an opening near its base to allow air to enter the shaft.

FIG. 27 is a top view of an illumination device similar to that shown in FIG. 26, with a plurality of openings 855 near the lip 830 that allow air to enter the shaft, for an example in which the shaft 811 does not have an opening near its base to allow air to enter the shaft. In this example, the lip 830 may extend further down into the shaft and encircle the fan, not shown, that pumps air upward through the lip and into the shroud, not shown. The openings extend further down than the lip, and provide air that enters the fan from below. A screen may optionally be provided that covers openings 855 while allowing air to flow through the openings, and optionally a screen may be provided for the openings between bars 840.

Figure 28:
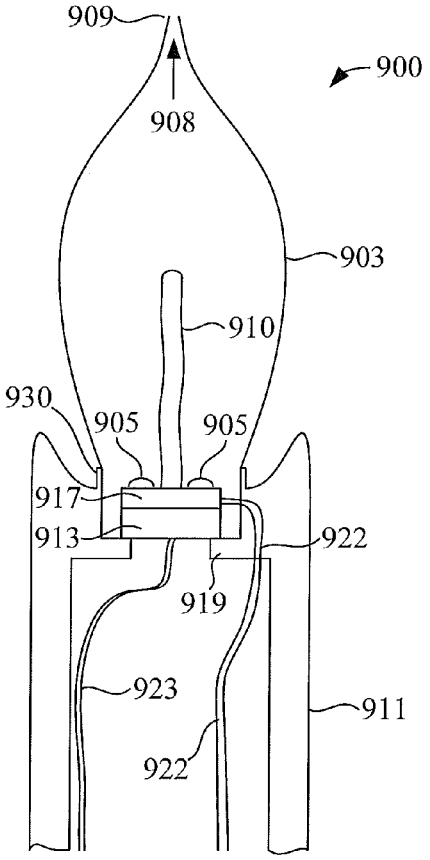
FIG. 28 is an opened-up schematic view of an illumination device having a light source including a plurality of LEDs, which illuminate a flexible shroud and a pole.

FIG. 28 is an opened-up schematic view of an illumination device 900 having a light source including a plurality of LEDs 905, which illuminate a flexible shroud 903 and a pole 910. The pole 910 is coated in an upper portion with red or orange paint, which may be fluorescent, to simulate a glowing candle wick. The light emitted from LEDs 905 illuminates the shroud 903, so that the shroud emits light while changing shape due to airflow, simulating a candle flame. In this embodiment a source of airflow may be a heat-sink-impeller structure 913 such as described in U.S. Published Application 2009/0199997, which is incorporated by reference herein for the description of that heat-sink-impeller structure, hereinafter simply referred to as fan 913. As described in that application, fan 913 rotates about an axis that is perpendicular to a back plate of substrate 917, drawing air into the fan along that axis, and pushing the air out of the fan in a radial direction. Fan 913 is disposed within a shaft 911 that simulates a generally cylindrical wax candle body, the shaft having a lip 919 that separates the air flowing into the fan near its axis from the air flowing out of the fan near its circumference.

The fan 913 forces air into the shroud 903, the air exiting the shroud at a hole 908 at its tip 909. As described above, waves in the shroud induced by the airflow may be accentuated by the low angle between light from an LED and the shroud's surface, simulating waves of flame travelling upward. Also as described above, the pressure of the air passing through hole 908 can cause the tip of the shroud 803 to wave around, like the end of a garden hose that snakes around due to the pressure of water shooting through it. This waving motion of the tip of the glowing shroud 803 simulates the flickering of a candle flame.

In this example, four LEDs 905 are disposed in a square pattern on the substrate 917 that may be in contact or near contact with fan 913. The substrate 917 may be attached to the shaft 911 with a plurality of arms, not shown, and the pole 910 may be attached to the shaft with the same or different arms. Although the pole 910 is shown adjoining an axial portion of the substrate 917, the pole may be separated from the substrate, for example by the arms or by a cover over the LEDs 905, not shown. Leads 922 provide power to the substrate 917, the leads 922 positioned outside the fan and within the cavity of shaft 911, although in this example the leads 922 traverse a part of the shaft near the lip 919. Leads 923 provide power to the fan 913, the leads 923 running within the cavity of shaft 911 to attach to the fan near its axially located stator. The shaft 911 may have at least one opening near its base to allow air to flow into the cavity housing the fan 913. The shroud 903 may be attached to an annular lip 930 of the shaft 911, the lip spaced from the substrate 917 to allow air propelled by the fan 913 to travel through an aperture in the shaft to inflate and actuate the sock.

Figure 29:
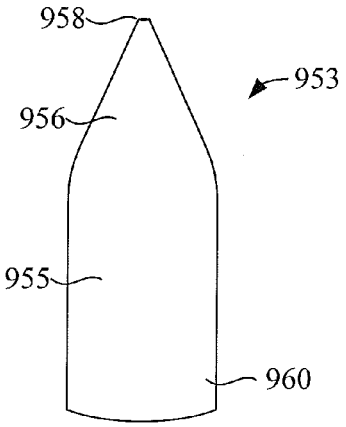
FIG. 29 is a perspective view of an embodiment of a flexible shroud 953 that does not require stretching to be removed from a mold.

As mentioned above, a shroud or sock such as shroud 803 or 903 may be made on a mold that is later removed, for example by processes similar to those used for latex or vinyl gloves or balloons. In this case, part of a bulb-shaped shroud or sock may be stretched in order to be removed from the mold, after which it can contract to its pre-stretched size. FIG. 29 is a perspective view of an embodiment of a flexible shroud 953 that does not require such stretching to be removed from a mold. The shroud 953 has a generally cylindrical shape along a first portion 955 and a smoothly tapered cone shape along a second portion 956, with an optional hole 958 at a tip of the shroud. When used as part of an illumination device as discussed herein, the shroud 953 may be folded at a lower region 960 to fit within or around an annular lip such as lip 830 or lip 930 of the previous two figures.

Figure 30:
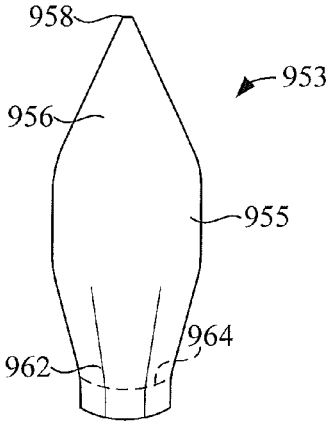
FIG. 30 is a perspective view of the shroud of FIG. 29 that has been attached to a ring that has a smaller diameter than that of the cylindrical region.

FIG. 30 is a perspective view of the shroud 953 of FIG. 29 that has been attached to a ring 964 that has a smaller diameter than that of the cylindrical region 955. The ring 964 is partly visible through the semi-transparent shroud. An evenly spaced plurality of folds 962 may be made in a lower region of the shroud to taper that region. Alternatively, an evenly spaced plurality of cuts 962 may be made, with the cut portions of the shroud overlapping in the portion attached to the ring.

Figure 31:
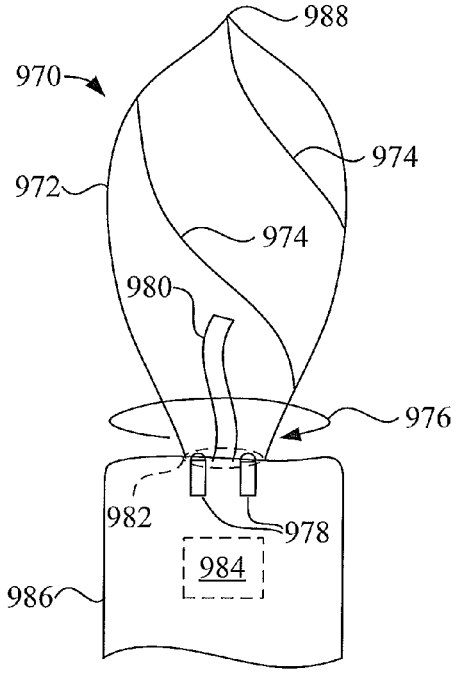
FIG. 31 is a schematic side view of an illumination device including a shroud that has a spiral pattern, so that a rising flame is simulated when the shroud is illuminated and rotated.

FIG. 31 is a schematic side view of an illumination device 970 including a shroud 972 that has a spiral pattern 974, so that a rising flame is simulated when the shroud is illuminated and rotated as shown by arrow 976 (counterclockwise looking down). The shroud 972 need not be flexible in this example, and the spiral pattern need not be evenly spaced. The spiral pattern 974 may be formed by the shape and/or coloring of shroud 972. For instance, each of the lines 974 may represent a slight ridge of shroud 970, or may represent a variation in intensity of a generally yellow color, or may represent different hues, such as yellow/blue/orange, or a combination of the above.

During rotation of the shroud 972, a plurality of LEDs 978 illuminate an interior of the shroud, including artificial wick 980, which may be colored red or orange and visible through shroud, which may be colored less in a lower region. An exemplary mechanism to rotate the shroud 972 can include a motor 984 disposed within generally cylindrical housing 986 that simulates a wax candle body. The shroud 970 in one example may ride on a circular track 982, powered by a gear that is attached to the motor and engages teeth near the track. Various other mechanisms can be used to rotate the shroud 970. To simulate a flickering candle flame, the shroud may rotate for example at a speed of between one and ten revolutions per second.

A slope of the spiral pattern may increase near a tip 988 of the shroud 970 to simulate acceleration of flickering flame. The shroud 970 and wick 980 may include fluorescent material or other coloring similar to that described in other embodiments. The LEDs 978 may emit yellow, white, blue or yellow-orange light similar to that described in other embodiments.

The foregoing description of the embodiments of the invention has been presented for the purposes of illustration and description. It is not intended to be exhaustive or to limit the invention to the precise form disclosed. For example, although an LED is disclosed other sources of electromagnetic radiation may instead be used. Many modifications and variations are possible in light of the above teaching. It is intended that the scope of the invention be limited not by this detailed description, but rather by the claims appended hereto.

Any advantages and benefits described may not apply to all embodiments of the invention. When the word "means" is recited in a claim element, applicant intends for the claim element to fall under 35 USC section 112, paragraph 6. A label of one or more words may precede the word "means", which is intended to ease referencing of claims elements and is not intended to convey a structural limitation. Such means-plus-function claims are intended to cover not only the structures described herein performing the function and their structural equivalents, but also equivalent structures. For example, although a nail and a screw have different structures, they are equivalent structures since they both perform the function of fastening. Claims that do not use the word means are not intended to fall 35 USC section 112, paragraph 6.

The invention claimed is:

1. An illumination device comprising:

a frame including a plurality of arms;

a plurality of light sources that are attached to the arms and emit electromagnetic radiation;

a plurality of flexible shrouds, each of the shrouds being operably coupled to a respective one of the light sources to receive the electromagnetic radiation from the respective light source and transmit visible light from the shroud; and a mechanism that is operably coupled to the shrouds and the light sources, the mechanism adapted to change the shape of the shrouds while the light is transmitted from the shrouds such that the shrouds simulate candle flames.

2. The device of claim 1, wherein the frame, light sources and flexible shrouds are parts of a chandelier.

3. The device of claim 1, wherein the shroud includes a fluorescent material.

4. The device of claim 1, wherein the electromagnetic radiation passes through the shroud as the visible light.

5. The device of claim 1, including a plurality of poles that simulate glowing candle wicks, each of the poles being operably coupled to one of the shrouds such that light from the pole traverses the shroud.

6. The device of claim 1, wherein the mechanism is adapted to inflate the shroud.

7. The device of claim 1, wherein each of the light sources includes a light-emitting diode (LED).

8. The device of claim 1, wherein the mechanism includes air flow.

9. An illumination device comprising:

a frame including a plurality of arms;

a plurality of light sources that are attached to the arms and emit electromagnetic radiation;

a plurality of flexible shrouds, each of the shrouds being operably coupled to one of the light sources to receive the electromagnetic radiation such that a first part of the electromagnetic radiation passes through the shroud as a first color of light and a second part of the electromagnetic radiation is absorbed and reradiated by the shroud as a second color of light; and a mechanism that is operably coupled to each of the shrouds and to each of the light sources, the mechanism adapted to change the shape of the shrouds while the first and second wavelengths of visible light are transmitted from the shrouds such that the shrouds simulate a plurality of candle flames.

10. The device of claim 9, wherein the frame, light sources and flexible shrouds are parts of a chandelier.

11. The device of claim 9, including a plurality of poles that simulate glowing candle wicks, each of the poles being operably coupled to one of the shrouds such that light from the pole traverses the shroud.

12. The device of claim 9, wherein the mechanism is adapted to inflate the shroud.

13. The device of claim 9, wherein each of the light sources includes a light-emitting diode (LED).

14. The device of claim 9, wherein the mechanism includes air flow.

15. A method for illumination comprising:

emitting electromagnetic radiation, by a plurality of light sources that are attached to a frame of a chandelier and operably coupled to a plurality of flexible shrouds, such that the electromagnetic radiation from each of the light sources impinges upon a respective one of the shrouds;

transmitting, by each shroud, visible light in response to receiving the electromagnetic radiation from its respective light source; and moving the shrouds such that the shrouds change shape during the transmitting, thereby simulating a plurality of candle flames that are arranged on the chandelier.

16. The method of claim 15, including inflating the shrouds during the transmitting.

17. The method of claim 15, wherein transmitting, by each shroud, visible light in response to receiving the electromagnetic radiation from its respective light source includes passing the electromagnetic radiation through the shroud as the visible light.

18. The method of claim 15, wherein transmitting, by each shroud, visible light in response to receiving the electromagnetic radiation from its respective light source includes fluorescing.

19. The method of claim 15, including traversing each shroud with light from a pole, thereby simulating a glowing candle wick.

20. The method of claim 15, wherein emitting electromagnetic radiation includes converting electricity to light with a light-emitting diode (LED).

21. The method of claim 20, including flowing air near the LED, thereby cooling the LED.

* * * * *